US007727037B2

(12) United States Patent
Fukuoka et al.

(10) Patent No.: US 7,727,037 B2
(45) Date of Patent: Jun. 1, 2010

(54) OUTBOARD MOTOR

(75) Inventors: Yoshihito Fukuoka, Shizuoka (JP); Yoshihiko Okabe, Shizuoka (JP); Hirotoshi Yamauchi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 12 days.

(21) Appl. No.: 12/345,924

(22) Filed: Dec. 30, 2008

(65) Prior Publication Data

US 2009/0176420 A1 Jul. 9, 2009

(30) Foreign Application Priority Data

Jan. 8, 2008 (JP) ..... 2008-001097

(51) Int. Cl.
*B63H 20/00* (2006.01)

(52) U.S. Cl. ..... 440/88 L; 123/196 W

(58) Field of Classification Search ..... 440/88 L, 440/88 R; 123/196 A, 196 W
See application file for complete search history.

(56) References Cited

U.S. PATENT DOCUMENTS 4,588,385 A * 5/1986 Suzuki et al. ..... 440/88 R
4,789,363 A * 12/1988 Wicklein ..... 440/2
5,687,688 A * 11/1997 Tsunoda et al. ..... 123/196 W
5,924,901 A * 7/1999 Takahashi et al. ..... 440/88 L
6,126,499 A * 10/2000 Katayama et al. ..... 440/88 R
6,425,790 B2 * 7/2002 Nakata et al. ..... 440/89 R
6,929,519 B2 * 8/2005 Ide et al. ..... 440/88 L
7,029,346 B2 * 4/2006 Yoshida et al. ..... 440/88 L
2001/0044245 A1 * 11/2001 Nakata et al. ..... 440/89
2002/0146946 A1 * 10/2002 Shibata et al. ..... 440/88
2008/0070739 A1 3/2008 Nakamura et al.
2008/0233815 A1 9/2008 Nakamura et al.

FOREIGN PATENT DOCUMENTS

WO 2007/007707 A1 1/2007

* cited by examiner

*Primary Examiner*—Lars A Olson
(74) *Attorney, Agent, or Firm*—Keating & Bennett, LLP

(57) ABSTRACT

An outboard motor includes a transmission device disposed on a middle portion of a drive shaft driven by an engine. The transmission device includes a forward-reverse switching device housed in a transmission case. Lubricating oil for lubricating the forward-reverse switching device is stored in the transmission case. The transmission case has a drain hole arranged to discharge lubricating oil in the transmission case that is provided in a lower portion of a side wall and in a position in front of the drive shaft, and a drain bolt for opening or closing the drain hole. An exposed opening for exposing the drain hole is provided in an upper case that covers the transmission case. As a result, work efficiency in discharging or draining of lubricating oil is greatly improved without requiring dismantling of a main body of the outboard motor.

5 Claims, 5 Drawing Sheets

OUTBOARD MOTOR

BACKGROUND OF THE INVENTION

1. Field of the Invention

The present invention relates to an outboard motor, in particular, an outboard motor with an improved drain construction for lubricating oil.

2. Description of the Related Art

Conventionally, an outboard motor disclosed in WO 2007-007707A1 includes a power transmission system provided on a middle portion of a drive shaft to transmit power of an engine to a propeller. The power transmission system has a speed changer constructed with a planetary gear mechanism.

Accordingly, the speed of power from the engine is changed by the speed changer, and the power is transmitted to the propeller. Thereby, the propeller rotates at a prescribed speed.

However, in such a conventional outboard motor, the speed changer and so forth of the power transmission system requires lubrication with lubricating oil. Further, the lubricating oil is required to be changed.

SUMMARY OF THE INVENTION

In view of the problems described above, preferred embodiments of the present invention provide an outboard motor having a structure that enables greatly improved work efficiency in discharging or draining lubricating oil without requiring dismantling of a main body of the outboard motor.

A preferred embodiment of the present invention provides an outboard motor including an engine provided in an upper portion, a drive shaft driven by the engine and arranged in a vertical direction, and a transmission device disposed on a middle portion of the drive shaft, wherein the transmission device has an automatic transmission system housed in a transmission case, a drain hole arranged to discharge lubricating oil provided in a lower portion of a side wall of the transmission case and in a position in front of the drive shaft, and an opening/closing member arranged to open or close the drain hole.

The transmission case is preferably disposed in an upper case, and an exposed opening is preferably arranged to face the drain hole in the upper case.

A guide member is preferably arranged to guide the lubricating oil discharged from the drain hole to the outside of the exposed opening.

The drain hole is preferably disposed below a steering shaft.

The drain hole is preferably covered by a cover detachably mounted on the outside of the upper case.

An oil pan of the transmission device preferably has the drain hole arranged to discharge lubricating oil in the oil pan provided in the lower portion of the side wall and in the position in front of the drive shaft and the opening/closing member. When lubricating oil is discharged from the oil pan when changing the oil, the outboard motor is tilted up, the opening/closing member is removed, and the lubricating oil can easily be discharged through the drain hole without requiring dismantling of the main body of the outboard motor. This allows an improvement in the work efficiency.

The transmission case is preferably disposed in the upper case, and the exposed opening is preferably provided in the upper case to face the drain hole. Therefore, lubricating oil can be discharged outside of the upper case from the drain hole via the exposed opening.

The guide member is preferably arranged to guide lubricating oil discharged from the drain hole to the outside of the exposed opening. Therefore, lubricating oil does not leak in a section between the oil pan and the upper case and can be certainly discharged to the outside of the upper case.

The drain hole is preferably disposed below the steering shaft. Therefore, the drain hole is not interfered with by the steering shaft and the like. This facilitates discharging of the lubricating oil.

The drain hole is preferably covered by the cover detachably mounted on the outside of the upper case. Therefore, the drain hole and the opening/closing member are not exposed to the outside in a normal state (a state in which the cover is put on). This ensures an appealing external appearance.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
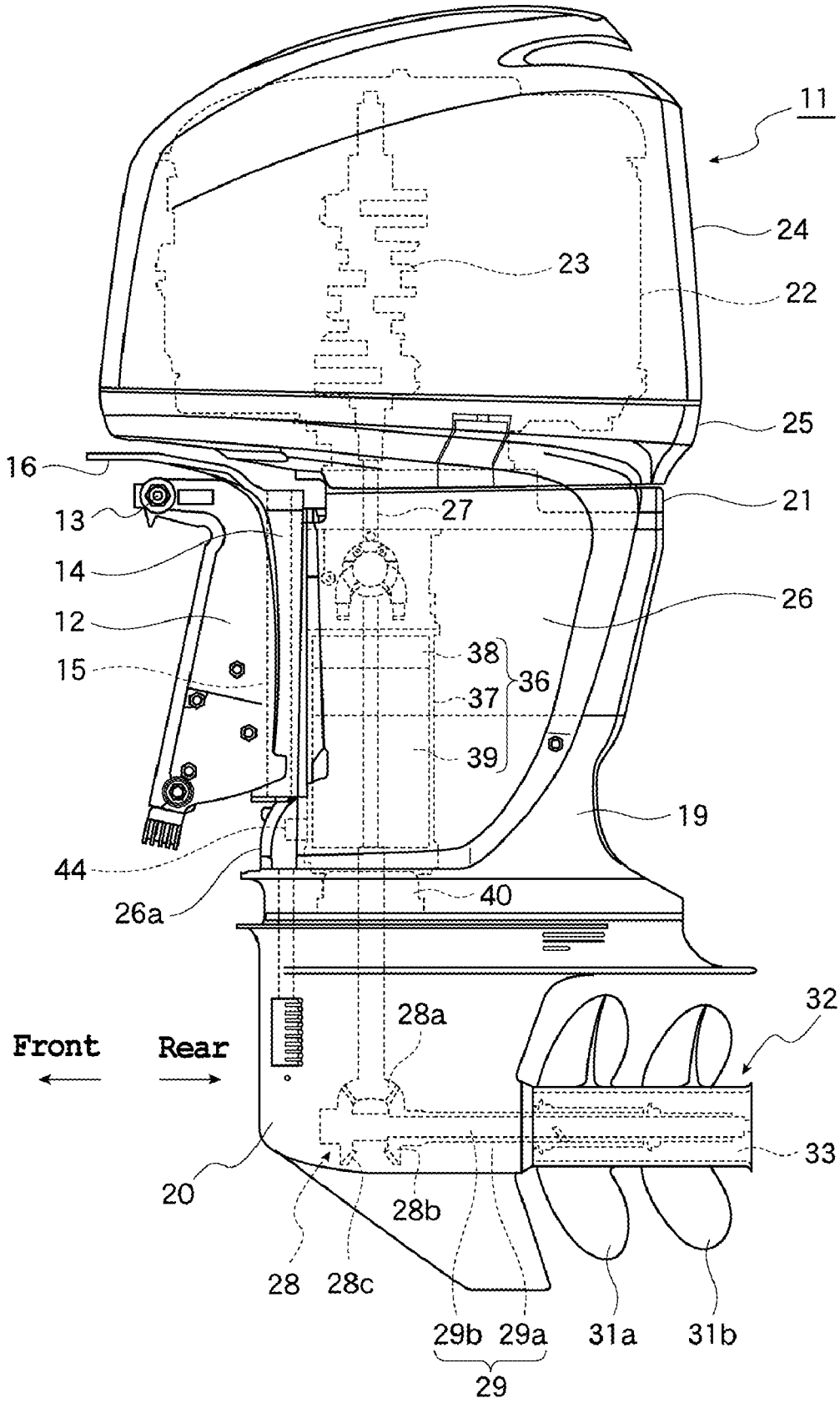
FIG. 1 is a side view of an outboard motor in accordance with a preferred embodiment of the present invention.

Preferred embodiments of the present invention will be described hereinafter.

FIGS. 1 through 5 show a preferred embodiment of the present invention.

First, a construction of the outboard motor will be described. An outboard motor 11 in accordance with a preferred embodiment is mounted on a transom of a hull (not shown).

The outboard motor 11 has a clamp bracket 12 fixed to the transom. A swivel bracket 14 is connected to the clamp bracket 12 via a swivel shaft 13 in the horizontal direction and a locking mechanism (not shown). A steering bracket 16 is connected to the swivel bracket 14 via a steering shaft 15 generally in the vertical direction.

The outboard motor 11 is supported by the steering bracket 16. The outboard motor 11 can be steered to the right and the left about the steering shaft 15, and can be tilted up above the water surface by vertically turning the swivel shaft 13.

In the outboard motor 11, a lower case 20 is provided below an upper case 19. A substantially flat mounting plate 21 is provided in an upper portion of the upper case 19. An engine 22 installed via the substantially flat mounting plate 21. The engine 22 is, for example, a V6 water-cooled engine, and is placed on the mounting plate 21 with a vertically-arranged crankshaft 23.

The upper case 19 preferably has a horizontally split construction, for example, in which an upper case section and a lower case section are fastened together by a plurality of fixing bolts or other fastening members, for example. The mounting plate 21 is fixed to an upper surface of the upper case section by a plurality of fixing bolts and through bolts or other fastening members, for example.

The engine 22 is covered by a detachable upper cover 24 and a lower cover 25. The right and left side surfaces of the upper case 19 are covered by a detachable side cover 26.

A vertical drive shaft 27 is pivotally supported in the upper case 19. An upper end of the drive shaft 27 is coupled to a lower end of the crankshaft 23 of the engine 22 preferably by spline-fitting, for example.

The drive shaft 27 preferably includes a plurality of coaxially-disposed shafts, extends downward in the upper case 19, and extends into the inside of the lower case 20. The drive shaft 27 is coupled to a propeller shaft 29 horizontally and pivotally supported in the lower case 20 via a bevel gear mechanism 28, thereby transmitting power.

The propeller shaft 29 is preferably a double rotating shaft in which an outer shaft 29*a* and an inner shaft 29*b* are coaxially combined. In the bevel gear mechanism 28, a drive bevel gear 28*a* unitarily rotates with the drive shaft 27, a driven bevel gear 28*b* unitarily rotates with the outer shaft 29*a*, and a driven bevel gear 28*c* unitarily rotates with the inner shaft 29*b*.

A first propeller 31*a* is fixed to the outer shaft 29*a*. A second propeller 31*b* is fixed to the inner shaft 29*b*. These members define a contra-rotating propeller mechanism 32. An exhaust path 33 is preferably located within the axial portions of the first propeller 31*a* and the second propeller 31*b*.

A transmission device 36 is provided in the upper case 19. The transmission device 36 is preferably pivotally installed in a middle portion of the drive shaft 27. A transmission planetary gear mechanism 38, as an example of an automatic transmission system, and a forward-reverse switching device 39 are housed in a transmission case 37 that defines a contour of the transmission device 36. Description will not be made about a detailed construction of the forward-reverse switching device 39 and so forth. A final speed reducer 40 including a planetary gear mechanism is provided below the transmission device 36 (see FIG. 1 and so forth).

Figure 5:
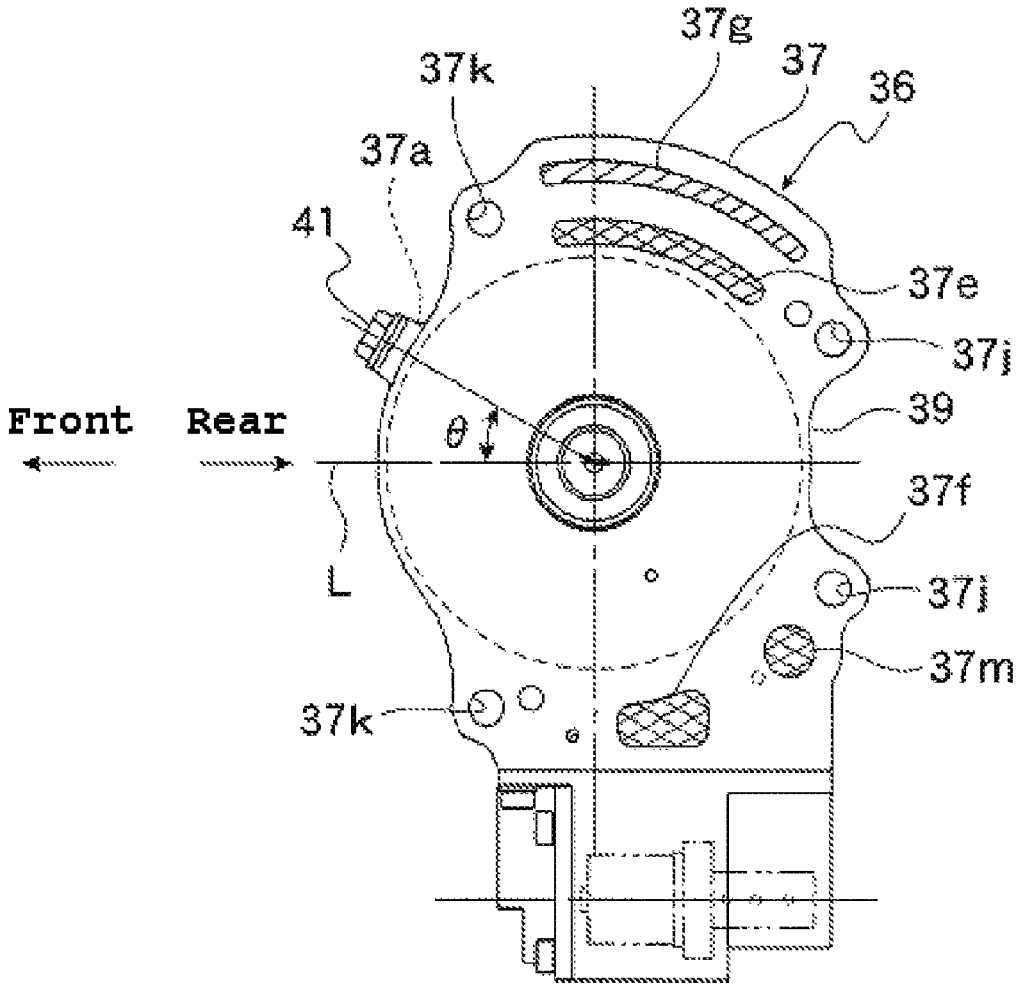
FIG. 5 is a plan view along line V-V of FIG. 4 in accordance with a preferred embodiment of the present invention.

Lubricating oil is preferably stored in an oil pan 37*d* in the transmission case 37. The lubricating oil lubricates gears, a clutch, and so forth of the forward-reverse switching device 39. As shown in FIG. 5, a lubricating oil dropping path 37*e*, a lubricating oil drawing path 37*f*, and a coolant path 37*g* are provided in the transmission case 37.

Figure 2:
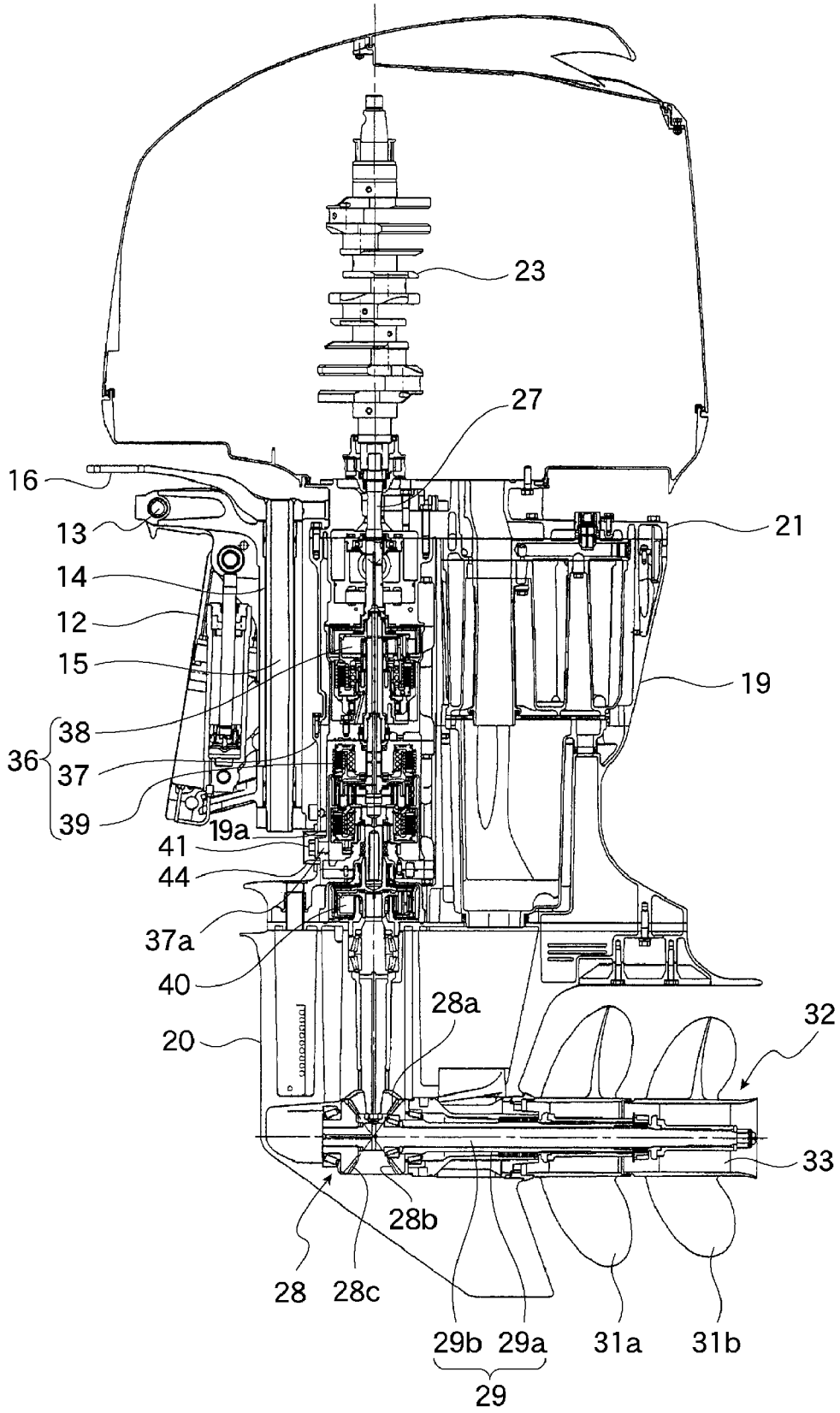
FIG. 2 is a cross-sectional view of the outboard motor in accordance with a preferred embodiment of the present invention.
Figure 3:
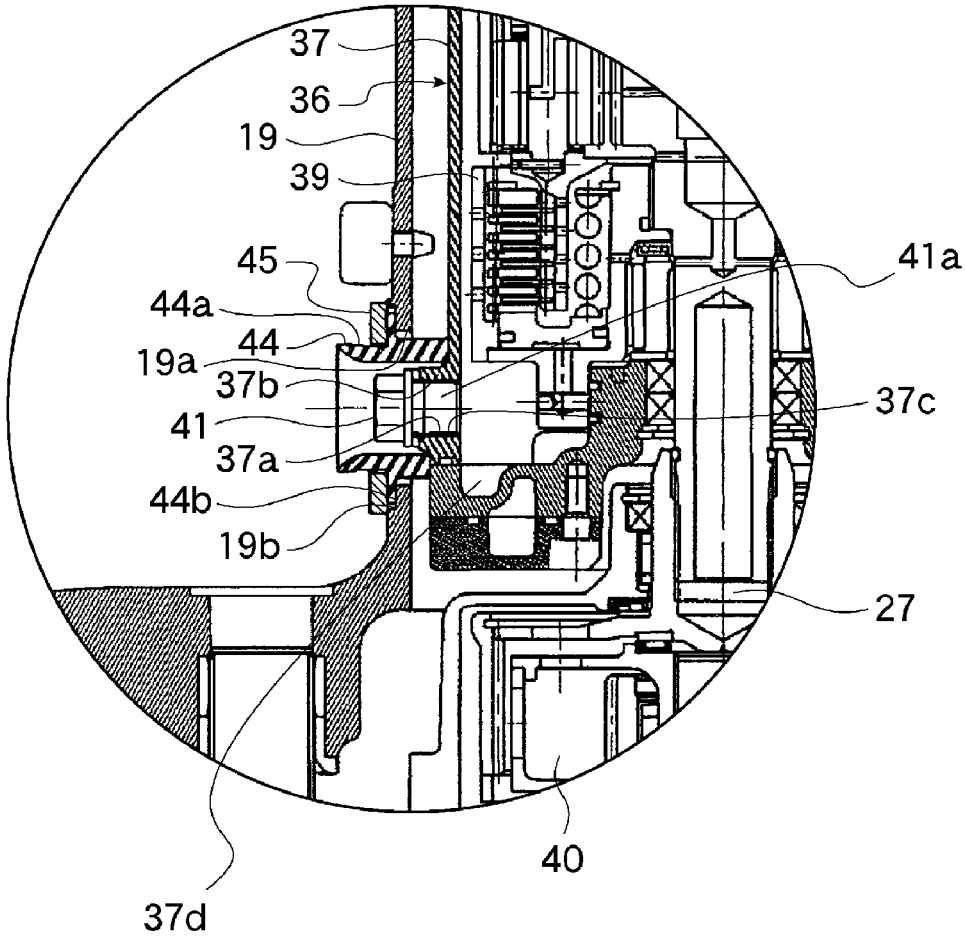
FIG. 3 is a cross-sectional view of the outboard motor in accordance with a preferred embodiment of the present invention showing elements thereof on a larger scale.
Figure 4:
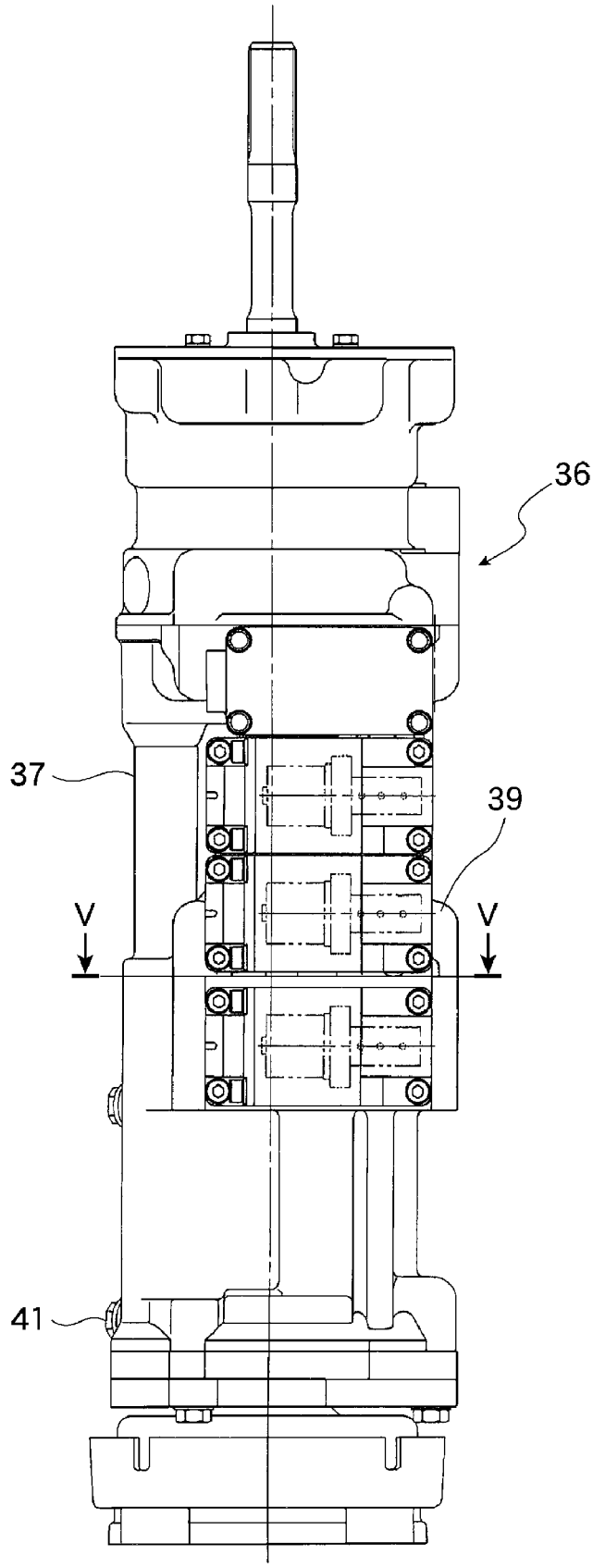
FIG. 4 is a front view of a transmission device in accordance with a preferred embodiment of the present invention.

As shown in FIGS. 2 and 3, the transmission case 37 has a drain hole 37*a* arranged to discharge lubricating oil in the transmission case 37 provided in a lower portion of a side wall and in a position in front of the drive shaft 27, and a drain bolt 41 as an "opening/closing member" that is arranged to open or close the drain hole 37*a*.

The drain hole 37*a* is preferably formed in a boss 37*b* protruding from the transmission case 37. A female thread 37*c* is preferably provided in an inside wall of the boss 37*b*. An external thread 41*a* of the drain bolt 41 is screwed into the female thread 37*c*.

As shown in FIG. 5, the drain hole 37*a* and so forth are not positioned on an extension line L in a fore-and-aft direction of the watercraft passing through the center of the transmission case 37, but are disposed in a position offset to the right or left by a small angle θ (for example, about 30° through about 45°). The lubricating oil drawing path 37*f* is arranged on the opposite side across the extension line L with respect to the position that the drain bolt 41 and so forth are disposed.

The transmission case 37 is preferably fastened by fastening bolts via four fastening bolt holes 37*j*, 37*j* and 37*k*, 37*k*, for example, as shown in FIG. 5. An interval between the two fastening bolt holes 37*k*, 37*k* on the front side is wider than an interval between the fastening bolt holes 37*j*, 37*j* on the rear side, thereby preventing the transmission case 37 from protruding forward and occupying a space in which the drain hole 37*a* is provided. Such a construction allows a reduction in the amount that the drain bolt 41 protrudes forward.

Further, as shown in FIG. 5, a hydraulic path 37*m* for operating a hydraulic clutch is provided in the transmission case 37. Hydraulic pressure is supplied to the hydraulic clutch through a solenoid valve from the hydraulic path 37*m*.

An exposed opening 19*a* is arranged to face the drain hole 37*a* in the upper case 19 covering the transmission case 37. The exposed opening 19*a* preferably has a circular or substantially circular shape, and preferably has a diameter that is larger than a diameter of the boss 37*b*.

Further, a guide member 44 is arranged to guide lubricating oil discharged from the drain hole 37*a* to the outside of the exposed opening 19*a*.

The guide member 44 is preferably formed of rubber and provided with a cylinder 44*a* and a flange 44*b* formed around the cylinder 44*a*. The cylinder 44*a* is fitted around the boss 37*b* and in to the exposed opening 19*a* of the upper case 19. An end of the cylinder 44*a* is preferably tapered, and protrudes outside from the upper case 19 for a given amount.

The flange 44*b* is fitted into a recess 19*b* formed in a periphery of the exposed opening 19*a* of the upper case 19. The flange 44*b* is pressed against the recess 19*b* by a pressing plate 45, thereby ensuring a good seal.

The drain hole 37*a* and so forth are disposed below the steering shaft 15.

The drain hole 37*a* and so forth are covered by a covering 26*a* of the side cover 26 detachably mounted on the outside of the upper case 19.

When the engine 22 starts, rotation of the crankshaft 23 is transmitted to the drive shaft 27. The rotational speed of the drive shaft 27 is changed in the transmission device 36, and the rotational direction thereof is switched into the forward or reverse direction. Further, the rotational speed is reduced by the final speed reducer 40 and transmitted to the propeller shaft 29. The outer shaft 29*a* of the propeller shaft 29 with the first propeller 31*a* and the inner shaft 29*b* of the propeller shaft 29 with the second propeller 31*b* rotate in opposite directions to generate a high propulsive force.

In such an outboard motor, in the case of changing lubricating oil, the side cover 26 is detached, and the outboard motor 11 is turned (tilted up) to a prescribed angle about the swivel shaft 13, thereby causing the outboard motor 11 to be in a leaning or tilting position.

In this position, a lubricating oil inlet provided in an upper portion of the transmission case 37 is opened, the drain bolt 41 is removed, and the drain hole 37*a* is opened. The drain hole 37*a* is positioned in the lower portion of the side wall of the transmission case 37 and in front of the drive shaft 27. Therefore, the drain hole 37*a* is positioned the lowest in the transmission case 37 when the outboard motor 11 is tilted up.

Accordingly, the drain bolt 41 is removed when the outboard motor 11 is tilted up to facilitate discharge of lubricating oil. At the time of discharge, lubricating oil is guided by the guide member 44 to the outside of the upper case 19 and discharged. Therefore, lubricating oil does not leak in a section between the transmission case 37 and the upper case 19.

Further, the flange 44*b* and so forth of the guide member 44 reliably seals a section between the guide member 44 and the periphery of the exposed opening 19*a* of the upper case 19. Therefore, seawater and so forth do not enter the section between the transmission case 37 and the upper case 19 through the exposed opening 19*a*.

Further, the drain hole 37*a* and so forth are disposed in front of the drive shaft 27 and thus are positioned adjacent to the steering shaft 15. However, the drain hole 37*a* and so forth are not interfered with by the steering shaft 15 when the drain bolt 41 is attached and detached since the drain hole 37*a* and so forth are disposed below the steering shaft 15. This facilitates the attaching and detaching operation.

In addition, the drain hole 37*a* and so forth are covered by the covering 26*a* of the side cover 26 in a normal state. This ensures a an appealing external appearance and prevents damage to the guide member 44 and so forth.

The drain hole 37*a* is offset by the angle θ, thereby preventing an increase in the amount that the drain bolt 41 protrudes forward. Accordingly, the outboard motor 11 can be disposed as close to the watercraft as possible when the transmission device 36 is provided on the drive shaft 27. Therefore, the center of gravity of the outboard motor 11 is positioned closer to the watercraft. This reduces a load on a support member of the outboard motor 11. The angle θ is preferably set to an angle position close to the maximum steering angle (for example, about ±32° from the center), thereby allowing discharge of the lubricating oil in a state in which the outboard motor 11 is tilted up and maintained at the maximum steering angle. This improves the work efficiency.

In the above-described preferred embodiments, the transmission device 36 is preferably capable of both speed change and direction switching. However, the present invention is not limited to this case, and the transmission device 36 may only be capable of either of the above functions.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An outboard motor comprising:

an engine provided in an upper portion;

a drive shaft driven by the engine and arranged in a vertical direction; and a transmission device disposed on a middle portion of the drive shaft; wherein the transmission device has an automatic transmission system housed in a transmission case, a drain hole arranged to discharge lubricating oil located in a lower portion of a side wall of the transmission case and in a position in front of the drive shaft, and an opening/closing member arranged to open or close the drain hole.

2. The outboard motor according to claim 1, wherein the transmission case is disposed in an upper case, and an exposed opening is arranged in the upper case so as to face the drain hole in the upper case.

3. The outboard motor according to claim 2, further comprising a guide member arranged to guide the lubricating oil discharged from the drain hole to the outside of the exposed opening.

4. The outboard motor according to claim 1, wherein the drain hole is disposed below a steering shaft.

5. The outboard motor according to claim 1, wherein the drain hole is covered by a cover detachably mounted on the outside of the upper case.

* * * * *